United States Patent [19]

Walton et al.

[11] Patent Number: 4,892,298

[45] Date of Patent: Jan. 9, 1990

[54] DEVICE AND METHOD FOR PICKUP OF SHEET-FORM FLEXIBLE FABRIC OR THE LIKE

[75] Inventors: Richard R. Walton, Ten W. Hill Pl., Boston, Mass. 02114; George E. Munchbach, Roslindale, Mass.

[73] Assignee: Richard R. Walton, Boston, Mass.

[21] Appl. No.: 909,996

[22] Filed: Sep. 22, 1986

Related U.S. Application Data

[63] Continuation-in-part of Ser. No. 500,621, Jun. 2, 1983, Pat. No. 4,641,827, and a continuation-in-part of Ser. No. 614,478, May 30, 1984, Pat. No. 4,645,193.

[51] Int. Cl.[4] ..... B65H 3/22

[52] U.S. Cl. ..... 271/18.3; 294/61; 414/796.9

[58] Field of Search ..... 271/18.3, 19, 20, 21, 271/22, 23, 24, 25, 264, 268, 92; 294/61, 88; 414/120; 221/210, 213

[56] References Cited

U.S. PATENT DOCUMENTS

| | | | |
|---|---|---|---|
| 793,009 | 6/1905 | Miller | 271/18.3 |
| 1,649,319 | 11/1927 | Molyneux | 464/58 |
| 1,780,195 | 11/1930 | Kinney | 271/18.3 |
| 2,837,333 | 6/1958 | Sindzinski | 271/12 |
| 2,878,016 | 3/1959 | Russell et al. | 271/11 |
| 2,919,129 | 12/1959 | Sjostrom | 271/33 |
| 3,026,109 | 3/1962 | Pfeffer | 271/32 |
| 3,064,968 | 11/1962 | Starnes | 271/19 |
| 3,083,961 | 4/1963 | Arbter | 271/33 |
| 3,126,201 | 3/1964 | Rehm | 271/32 |
| 3,168,307 | 2/1965 | Walton et al. | 271/26 |
| 3,168,308 | 2/1965 | Walton et al. | 271/27 |
| 3,176,979 | 4/1965 | Englemann | 271/18 |
| 3,253,827 | 5/1966 | Southwell et al. | 271/19 |
| 3,291,480 | 12/1966 | Haddad | 271/1 |
| 3,353,821 | 11/1967 | Smith et al. | 271/16 |
| 3,355,165 | 11/1967 | Southwell et al. | 271/12 |
| 3,369,803 | 2/1968 | Walton et al. | 271/10 |
| 3,386,396 | 6/1968 | Jacobs et al. | 112/2 |
| 3,386,763 | 6/1968 | Ottaway et al. | 294/61 |
| 3,406,961 | 10/1968 | Walton | 271/10 |
| 3,406,966 | 10/1968 | Walton | 271/68 |
| 3,430,949 | 3/1969 | Herdeg et al. | 271/63 |
| 3,442,505 | 5/1969 | Szentkuti | 271/1 |
| 3,531,103 | 9/1970 | Walton | 271/26 |
| 3,539,177 | 11/1970 | Schwenk | 271/33 |
| 3,547,432 | 12/1970 | Herdeg | 271/20 |
| 3,550,932 | 12/1970 | Mason | 271/26 |
| 3,583,341 | 6/1971 | Birdsong | 112/121 |
| 3,583,695 | 6/1971 | Sherwood | 271/21 |
| 3,588,087 | 6/1971 | Rovin | 270/58 |
| 3,588,091 | 6/1971 | Stone et al. | 271/19 |
| 3,588,092 | 6/1971 | Dubes | 271/19 |

(List continued on next page.)

FOREIGN PATENT DOCUMENTS

| | | | |
|---|---|---|---|
| 0128480 | 12/1984 | European Pat. Off. | 271/18.3 |
| 2502325 | 7/1975 | Fed. Rep. of Germany | 271/18.3 |
| 2188578 | 1/1974 | France . | |
| 1218433 | 1/1971 | United Kingdom . | |

OTHER PUBLICATIONS

Murray, John M., "Single-Ply Pickup Devices", Bobbin, AAMA Apparel Research Journal, Dec. 1975, pp. 87–99.

(List continued on next page.)

*Primary Examiner*—Joseph J. Rolla
*Assistant Examiner*—Edward S. Ammeen

[57] ABSTRACT

A pickup device for a piece of sheet-form flexible fabric or the like includes first and second fabric gripping elements that come together at the face of the fabric piece to grip a localized portion of the fabric, a support for resiliently biasing the fabric gripping elements together in a gripping position, and an actuatable separator for applying force to overcome the biasing to move the fabric gripping elements apart. Upon deactuation of the separator, the support is adapted to resiliently return the gripping elements to the gripping position. A pickup system and method for loosening and removing a single face piece of fabric from a stack of pieces aligned at an edge are also described in which a vacuum stabilizing system is combined with a jet directing air under the raised edge of a fabric piece.

11 Claims, 5 Drawing Sheets

U.S. PATENT DOCUMENTS

| | | | |
|---|---|---|---|
| 3,593,991 | 7/1971 | Baron | 271/70 |
| 3,625,506 | 12/1971 | Rovin | 271/18 |
| 3,632,106 | 1/1972 | Schwenk | 271/68 |
| 3,670,674 | 6/1972 | Connor, Jr. | 112/121.29 |
| 3,672,314 | 6/1972 | Firestein et al. | 112/121.29 |
| 3,685,471 | 8/1972 | Reynolds | 112/121.29 |
| 3,704,884 | 12/1972 | Nicolay | 271/85 |
| 3,710,953 | 1/1972 | Kirsch | 294/64.1 |
| 3,727,775 | 4/1973 | Beazley | 112/121.29 |
| 3,747,919 | 7/1973 | Stewart et al. | 271/19 |
| 3,756,587 | 9/1973 | Lutts et al. | 271/20 |
| 3,806,114 | 4/1974 | Carter | 271/20 |
| 3,809,388 | 5/1974 | Downing | 271/20 |
| 3,813,094 | 5/1974 | Walton | 271/19 |
| 4,239,205 | 12/1980 | Bourque | 271/175 |
| 4,444,384 | 4/1984 | Keeton | 271/18.3 |
| 4,505,468 | 3/1985 | Heisler | 271/18.3 |
| 4,526,363 | 7/1985 | Fort | 271/18.3 X |

OTHER PUBLICATIONS

USM Fabric Feeder, Model UFFM, USM.

USM Today, Oct., 1970, USM.

Fabri-Feed, USM Fabric Edge Finishing Machine Model UFEF, USM.

The Revolutionary Hydrafolder, Hydraxtor Company.

Fabri-Feed, USM Knit Sleeve Hemming System, Model UKSH, USM.

Clupicker Automated Systems, Jetscrew from Cluett.

Gepec Cloth Pickup, Gepec Machinery.

Fabri-Feed, USM Label Fusing System, Model ULF-S-B, USM.

FIG 1
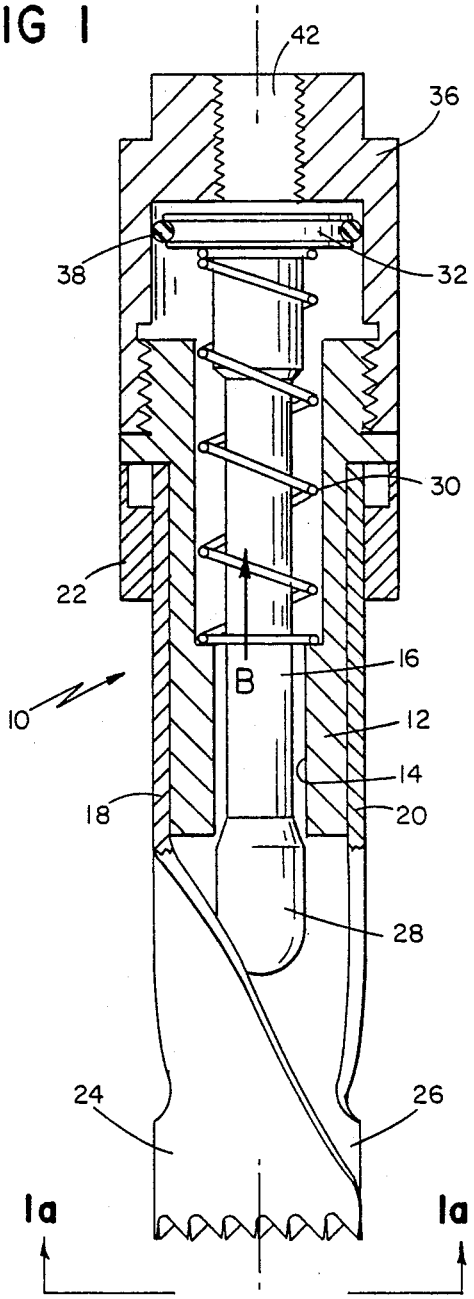
FIG 2
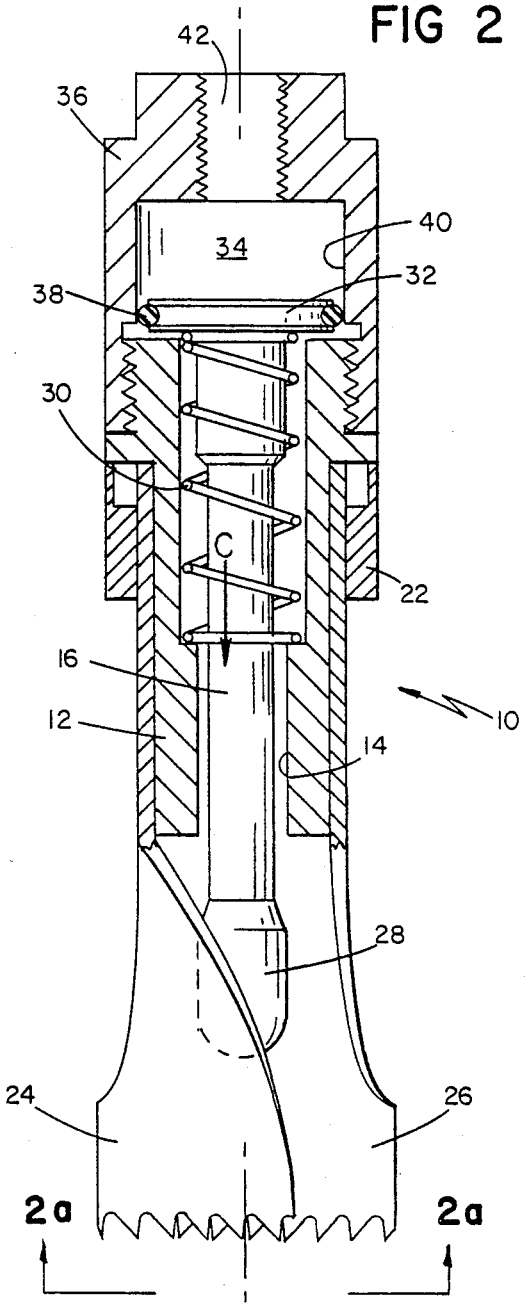
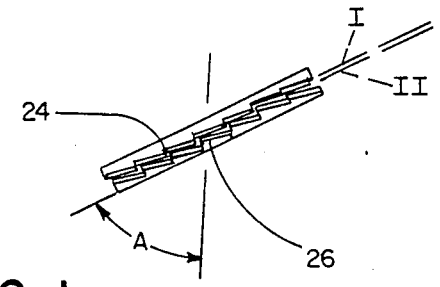
FIG 1a
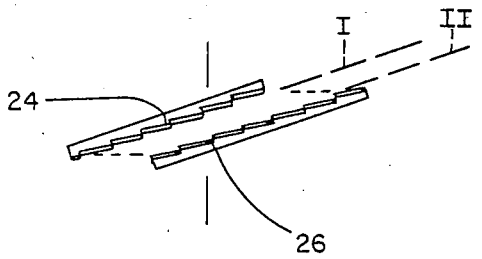
FIG 2a

DEVICE AND METHOD FOR PICKUP OF SHEET-FORM FLEXIBLE FABRIC OR THE LIKE

This application is a continuation-in-part application of U.S. Ser. No. 500,621, filed June 2, 1983, now U.S. Pat. No. 4,641,827, and of its continuation-in-part application U.S. Ser. No. 614,478, filed May 30, 1984, now U.S. Pat. No. 4,645,193.

The invention relates to an automated device and system for picking up a piece of fabric, e.g., from the face of a stack of pieces, for transport to the location of another process step.

For many decades, the step of manual pickup has been a chief obstacle to automated manufacture of garments. It has long been possible to efficiently form a stack of identically shaped component pieces for a garment by simultaneous cutting with a fabric saw through a multiplicity of overlying layers, guided by a pattern. Likewise, accurate sewing together of the various components has been efficiently accomplished as by use of automated platens and high speed sewing machines. The possibility of computer control in recent years has increased the speed of such techniques that already had been quite fast.

But between the steps of forming the stack and sewing together the individual pieces there has remained the tedious manual step of picking up individual pieces from a stack or other surface. Thread entanglement at the cut edges of the pieces, edge welds due to action of the saw or laser, the limpness of the pieces, laps, holes and variation in fabric texture and other parameters from piece to piece, have together made pickup and separation problems one of the chief obstacles to elimination of the slowness and expense of manual labor in the garment industry.

Our own work has resulted in the development of a new pickup device that has performed reliably in removing a single piece of fabric or the like from a stack of pieces. This device is described in U.S. Ser. No. 500,261, filed June 2, 1983, and now U.S. Pat. No. 4,641,827, and in its continuation-in-part, U.S. Ser. No. 614,478, filed May 30, 1984 and now U.S. Pat. No. 4,645,193, of which this application is a continuation-in-part. Both applications are incorporated herein by reference.

SUMMARY OF THE INVENTION

According to one aspect of the invention, a pickup device for a piece of sheet-form flexible fabric or the like comprises first and second fabric gripping elements adapted to come together at the face of the fabric piece to grip a localized portion of the fabric, support means for resiliently biasing the fabric gripping elements together in a gripping position, actuatable separating means for applying force to overcome the biasing to move the fabric gripping elements apart, upon deactuation of the separating means, the support means adapted to resiliently return the gripping elements to the gripping position.

In preferred embodiment, upon deactuation of the separating means, the support means are constructed and arranged to carry the gripping elements simultaneously in a direction generally toward each other and in a lateral direction to tension the fabric, whereby, when the gripping elements reach their final gripping position, the fabric has previously been tensioned by lateral motion of the gripping elements; the separating means are air actuated, preferably a camming means; the gripping elements are specially shaped to accommodate and clamp a tension-produced gather in the face of the fabric; teeth on the first gripping element are matched in opposition to respective teeth on the second gripping element, against which they clamp the fabric, preferably teeth of the first and second gripping elements are adapted to enter into spaces between teeth respectively of the second and first gripping elements as they clamp the fabric; the gripping elements are mounted on supports that resiliently close together to produce the motion of the gripping elements upon deactuation of the separating means, and the separating means comprises a camming means arranged to force the supports apart; preferably the supports comprise a pair of elongated spring arms that are biased together, the camming means comprising means slidable between opposed inner surfaces of the spring arms to progressively force them apart, and preferably the elongated spring arms are arranged to move relatively in a predetermined lateral direction between open and closed positions and each of the gripping elements comprises a set of points conforming to the plane of the face and set at an angle to the predetermined lateral direction and the supports comprise a pair of elongated spring arms that are biased together, the gripping elements define gripping lines that come together in the gripping position, and the separating means comprises a carrying means slidable between opposed inner surfaces of the spring arms to progressively move the gripping lines apart, the gripping lines lying at an angle to the direction of movement of the spring arms. Also, the pickup device is employed in combination with means for moving the device in a conveying motion away from a position at which the fabric piece is gripped; and the device is arranged above a stack of pieces and adapted for removing a face piece only from the stack.

In a set of pickup devices, such as described above, the devices in the set are arranged in a predetermined pattern in a pickup assembly, the pattern related to the peripheral shape of the piece of fabric to be picked up, the pickup assembly adapted to be moved while the pickup devices are gripping the fabric piece, maintaining control of the piece so that it can be deposited in a selected orientation of the periphery of the piece, preferably the set of devices is adapted for picking up a face piece of fabric from a stack of pieces, including at least first the pickup device near the periphery of the piece of fabric and at least a second the pickup device spaced from the periphery, the pickup devices, after gripping the piece of fabric, adapted to be raised from the stack in a predetermined sequence, whereby the first pickup device nearer the periphery is raised first and the second pickup device spaced from the edge is raised thereafter in a timed relationship to effect peeling of the piece of fabric from the stack.

According to another aspect of the invention, an apparatus useful in removing a single face piece of flaccid fabric or the like from a stack of edge-aligned pieces, comprises a support surface for the stack, a stack stabilizing device comprising vacuum inlet means defined in a stabilizing surface extending parallel to the aligned edges, the surface exposed directly for contact with the edges of the edge-aligned fabric pieces in the stack, and a source of vacuum adapted for drawing vacuum through the vacuum inlet means, air jet means comprising a nozzle having its outlet axis disposed above the vacuum inlet means and above and generally over the face piece of fabric in the stack, and a source of pressurized air for projecting air through the nozzle in a jet, at least one pickup device disposed in a manner to engage the face piece of fabric adjacent the aligned edge, and means for raising the pickup device relative to the stack to lift the edge region of the face piece from the stack to permit a jet of air from the nozzle to flow beneath the edge region of the face piece of fabric and over the stack, in a manner to promote disengagement of the face piece from the stack.

In preferred embodiments of this aspect, the invention comprises a set of pickup devices, at least a first of the pickup devices disposed in a manner to engage the face piece of fabric adjacent the aligned edge, and at least a second of the pickup devices disposed in a manner to engage the face piece of fabric at a position spaced from the aligned edge, and means for raising the pickup devices in sequence to cause the face piece of fabric to be lifted from the stack in a peeling motion beginning at the aligned edge; the stack stabilizing device further comprises a substantially imperforate flexible member having a first portion disposed in a manner, under influence of vacuum from the vacuum inlet means, to bear upon the face piece of the fabric adjacent the stabilizing surface; the substantially imperforate flexible member has a second portion disposed relative to the stabilizing surface in a manner, under influence of vacuum, to cover portions of the vacuum inlet means exposed above the stack; the vacuum source is adapted to provide at least a portion of the air in the jet from the nozzle; the pickup device comprises two gripping elements, each defining a gripping line adapted to engage the face piece of fabric, the lines being parallel, and means to move the lines toward each other along a path at an acute angle to the direction of the lines to clamp a portion of the face of the fabric, preferably the gripping elements are mounted on supports that resiliently close together, and separating means are arranged to force the supports apart prior to engagement of the line with the face piece of fabric, and the separating means are adapted to release the force to allow motion together of the gripping elements, more preferably the separating means is a camming means; the pickup device comprises first and second fabric gripping elements adapted to come together at the face of the fabric piece to grip a localized portion of the fabric, support means for resiliently biasing the fabric gripping elements together in a gripping position, actuatable separating means for applying force to overcome the biasing to move the fabric gripping elements apart, upon deactuation of the separating means, the support means adapted to resiliently return the gripping element to the gripping position.

According to still another aspect of the invention, an apparatus for transporting a flaccid piece of fabric comprises a set of pickup devices mounted on support means arranged to move between a first and a second station, the pickup means being air-actuated to move from a normally closed gripping position to an open release position, air supply means at both the first and second stations, the support means including means to engage the air supply means to provide air to the pickup devices, whereby, at the first station, the pickup devices may be opened by the respective air supply means and allowed to reclose to grip the piece of fabric, the support means may move away from the first station carrying the piece of fabric therewith in the absence of air, and, at the second station, the pickup devices may be opened by the respective air supply means to deposit the piece of fabric.

According to a further aspect of the invention, a method for removing a single face piece of flaccid fabric or the like from a stack of edge-aligned pieces comprises providing a support surface for the stack and a stack stabilizing device comprising vacuum inlet means defined in a stabilizing surface, disposing the stack upon the support surface with the aligned edges in contact with the stabilizing surface, drawing a vacuum through the vacuum inlet means to retard removal of the fabric pieces, engaging the face piece of fabric with at least one pickup device, the pickup device engaging the face piece of fabric adjacent its aligned edge, raising the pickup device and the engaged face piece of fabric from the stack, and causing a jet of air projecting from a nozzle to blow below the face piece of fabric as it is raised from the stack, in a manner to cause the face piece to flutter, thereby disengaging the face piece from underlying pieces of fabric in the stack.

In preferred embodiments of the method, prior to raising the pickup device, a jet of air is caused to flow over the upper surface of the face piece; an array of pickup devices is disposed over the face piece, at least a first of the pickup devices engaging the face piece of fabric adjacent its aligned edge and a second the pickup device engaging the face piece of fabric at a position spaced from the aligned edge, the method comprising raising the first pickup device before raising the second pickup device in a manner to peel the face piece from the stack; the method further comprises focusing the vacuum drawn through the vacuum inlet means into the stack of fabric pieces by disposing a portion of a substantially imperforate flexible member relative to the stabilizing surface in a manner, under influence of vacuum, to cover portions of the vacuum inlet means exposed above the stack; a substantially imperforate flexible member has a portion disposed in a manner, under influence of vacuum from the vacuum inlet means, to bear upon the face piece of the fabric adjacent the stabilizing surface; and the pickup device comprises first and second fabric gripping elements adapted to come together at the face of the fabric piece to grip a localized portion of the fabric, the device including support means for resiliently biasing the fabric gripping elements together in a normally closed gripping position, actuatable separating means for applying force to overcome the biasing to move the fabric gripping elements apart, upon deactuation of the separating means, the support means adapted to resiliently return the gripping elements to the gripping position, and the method further comprises: actuating the separating means to overcome the biasing to force the gripping elements apart prior to engagement of the gripping elements with the face piece of fabric, with the gripping elements engaged with the fabric, deactuating the separating means to allow the support means to resiliently return the gripping elements to the gripping position to grip the fabric, moving the pickup device to transport the piece of fabric, and, after movement of the pickup device to a new location, actuating the separating means to cause release of the piece of fabric, preferably the method further comprises: connecting the pickup devices to a first actuating means prior to engaging the face piece of fabric on the stack, and connecting the pickup devices to a second, different actuating means prior to releasing the face piece of fabric at the new location, the pickup devices remaining in the first, fabric gripping position while disconnected from the actuating means.

According to another aspect of the invention, a method for pickup of a piece of sheet-form flexible fabric or the like comprises providing a pickup device comprising first and second fabric gripping elements adapted to come together at the face of the fabric piece to grip a localized portion of the fabric, the device including support means for resiliently biasing the fabric gripping elements together in a normally closed gripping position, actuatable separating means for applying force to overcome the biasing to move the fabric gripping elements apart, upon deactuation of the separating means, the support means adapted to resiliently return the gripping elements to the gripping position, actuating the separating means to overcome the biasing to force the gripping elements apart prior to engagement of the gripping elements with the face piece of fabric, with the gripping elements engaged with the fabric, deactuating the separating means to allow the support means to resiliently return the gripping elements to the gripping position to grip the fabric, moving, the pickup device to transport the piece of fabric, and, after movement of the pickup device to a new location, actuating the separating means to cause release of the piece of fabric.

In preferred embodiments, the method further comprises: connecting the pickup devices to a first actuating means prior to engaging the piece of fabric and connecting the pickup devices to a second, different actuating means prior to releasing the face piece of fabric at the new location, the pickup devices remaining in the first, fabric gripping position while disconnected from the actuating means.

Thus there is provided a relatively inexpensive pickup device useful alone or more preferably in a system of a multiplicity of pickup devices for pickup of a piece of fabric, e.g., a face piece from a stack of pieces, even where separation is difficult, e.g., due to thread entanglement, edge welding, etc., and moving the fabric piece to be deposited for further processing at some location remote from the stack, the pickup device positively gripping the fabric during transport, even while disconnected from an actuating source. A method for pickup of a face piece from a stack of pieces is also provided.

These and other objectives and features of the invention will now be understood from the following description of a preferred embodiment and from the claims.

PREFERRED EMBODIMENT

We first briefly describe the drawings.

FIG. 1 is a side section view of a preferred embodiment of the invention with the gripping elements in their normally closed position, while FIG. 1*a* is an end view taken along line 1*a*—1*a* of FIG. 1, FIG. 2 is a side section view similar to FIG. 1, with the device actuated to separate the gripping elements, while FIG. 2*a* is an end view along line 2*a*—2*a l of FIG. 2;*

FIGS. 2*b*, 2*c* and 2*d* are side, end and axial views respectively, of an enlarged scale, of a pair of the gripping elements of FIGS. 1, 2 showing their matched teeth, while FIGS. 2*e* and 2*f* are side and end views of one of the elements illustrating steps in its manufacture;

FIGS. 4 and 5 are side and plan views, respectively, of the apparatus of FIG. 3, while

Figure 2B:
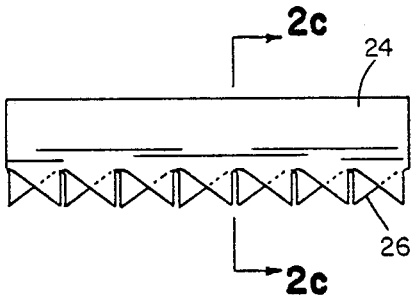
Figure 2C:
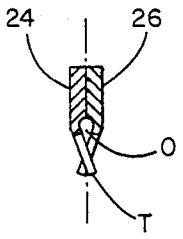
Figure 2D:
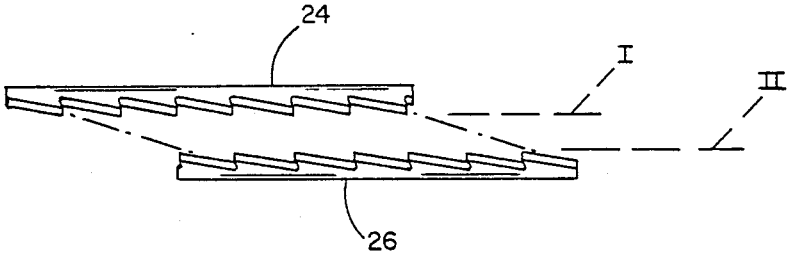
Figure 2E:
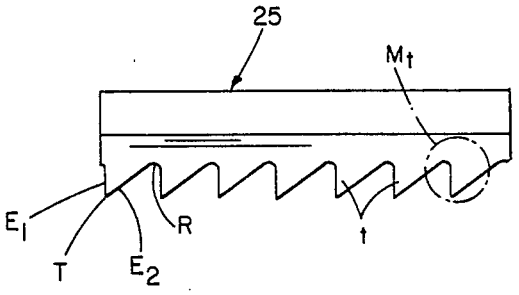
Figure 2F:
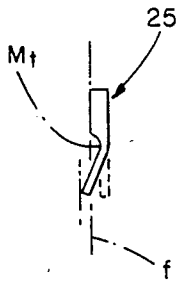

The pickup device 10 includes a body member 12 defining an axial bore 14 within which is disposed an axially-moveable piston rod 16. A pair of elongated arms 18, 20, formed of resilient spring metal, are affixed flat to the body member 12 at opposite sides, e.g., by soldering, and held in place by a fixed retaining ring 22, to extend axially beyond the body. The arms are formed of spring steel flat stock, 0.032 inch thick. The upper portion of the arms, 18,20 along the body member 12 are about 0.25 inch wide and the arms are 1.312 inches long, terminating in gripping elements 24, 26 which form a pair of opposed gripping lines, I and II. The arm extensions are formed to bias the gripping elements together, at rest, to lie resiliently together in fabric-gripping position (FIG. 1*a*), with the gripping lines substantially parallel, at an angle, A, typically about 60°, to a plane of the body parallel to the arm portions affixed to the flat, side surfaces of the body. The enlarged head 28 of the rod 16 is disposed between the arm extensions and defines camming surfaces for engaging the inner surfaces of the arm extensions to overcome the biasing and separate the arms carrying the gripping elements, 24, 26 as described below. In the fabric-gripping position (FIG. 1), the head of the piston rod is urged out of the camming engagement, in the direction of arrow, B, by compression spring 30.

The end of piston rod 16 forms a piston 32 within the cylinder 34 defined by cylinder cap 36 disposed on body member 12. Seal 38, disposed in a circumferential groove about the piston, engages the side wall 40 of the cylinder in sealing contact. Inlet 42 defines a conduit for introduction of compressed air into the cylinder.

Referring to FIG. 2, to remove a single fabric piece, e.g., from a stack of pieces, one or any number of pickup devices are connected to an actuating source of compressed air which is introduced via inlet 42 into cylinder 34. The air pressure within cylinder 34 acts against piston 32 to urge the piston rod in the direction of arrow C, compressing spring 30 and causing the camming surfaces of head 28 to act against the inner surfaces of arm extensions, separating gripping lines I and II while resiliently deflecting the arms from their normally closed position.

The pickup device 10 is lowered to the face of a piece of fabric to be picked up, e.g., the top piece of a stack. When the gripping lines I and II engage the face of the fabric, air pressure is deactuated, causing the piston rod 16 to move in the direction of arrow, B, under urging of spring 30. The removal of the camming surfaces allows arms 24, 26 to return toward their normally closed position, causing the gripping lines I and II, which are set at an angle to the cammed motion, to simultaneously move laterally, tensioning the fabric, and move generally together to clamp the fabric. The net result of the action depicted is to effect a positive grip on the top fabric piece in a stack, 64 without harm to the top piece and while creating conditions, e.g. a gather in the top piece, that decrease the tendency for any second piece of fabric to follow the first. Much of the problem in the separation of the top piece from a stack 64 without disturbing the second piece arises from fiber engagement between the two pieces. However, when the top piece is placed under significant local tension, its frictional engagement with the second piece is decreased and it more readily slides over the face of the stack without disturbing the stack. Furthermore, there may occur somewhat of a wedging action in the nip between the two gripping elements as they close together; the accumulation of pleated material of the first piece between the elements tends to press downwardly and to exclude the second piece.

FIGS. *2b*, *2c* and *2d* illustrate one form of gripping elements.

Referring to FIGS. *2e* and *2f*, a band saw blade 25 of, e.g., 14 teeth per inch is first milled at $M_t$ to reduce the thickness of the teeth, t, and the root region, R. When this is complete, the teeth have the shape shown in the dotted lines of FIG. *2f*. The teeth are collectively bent toward the side from which the material has been milled, preferably the tips being bent beyond the face plane, f, of the blade.

Referring back to FIG. *2e*, the frontal edge surfaces $E_1$ of the teeth are substantially vertical to the tips, T, of the teeth, t. The trailing edge surfaces, $E_2$, extend from the tips, T, at an acute angle. This special shaping of the teeth is found to be important in limiting the penetration of the tip piece, a particularly important feature when the top piece is to be removed from a stack of pieces. When the gripping elements 24 and 26 close together, the frontal surfaces, $E_1$, face in the direction of motion and engage the face of the material to produce the gathers or pleats previously mentioned. It is found that the substantial vertical nature of these frontal surfaces tends to limit penetration through the top piece, due to the blunt, non-wedging nature of the frontal surface.

Two of these blade-form members 24, 26 are mounted in the pickup apparatus in the manner suggested in FIGS. *2b*, *2c* and *2d*. Thus the teeth take the dashed line paths of FIG. *2d* as they close together, and in their final motion, for certain fabrics, they preferably intermesh as shown in FIG. *2c*, with points, T, of the teeth entering the space between teeth of the opposing line, thus to obtain an exceedingly strong grip on the fabric. Meanwhile the opening, O, provided by the milled away region $M_t$ on each element accomodates tension-produced gathers or ridges in the fabric and thus allows the points of the teeth to come together as described.

For certain fabrics, other arrangements for the gripping surfaces are, of course, possible, e.g., a coarse plasma coating of carbide particles on straight clamp surfaces. The gripping surface is chosen with regard to the nature of the fabric, e.g., whether coarsely or finely woven or knitted, the nature of the substance from which the fabric is made and the forces to which the piece are to be subjected. In general, the motion of the present invention makes it readily possible to select gripping elements which do not detrimentally pierce, but instead merely squeeze the fabric.

Once the fabric is gripped, the pickup devices may be subjected to vibrations, twisting, sudden movements, various blasts of air and other actions for the purpose of aiding in the separation of the piece of fabric from a stack, or in orienting or treating the fabric. The firm grip afforded by the intermeshed teeth can withstand very vigorous action in this regard.

When the gripping elements have achieved the position of FIG. 1, the pickup devices are moved relatively away from the stack, carrying a gripped fabric piece. During this period, it is not necessary to maintain the device in contact with activating air pressure to keep the gripping arms 24, 26 closed together; rather, the gripping arms remain closed in the absence of air flow into the cylinder, and can be moved, e.g., between process steps, without the problem of maintaining air flow connections. When the pickup device has been moved to the position for release, inlet 42 is once again connected to an air source. As piston rod 16 is urged downward by the actuating force of air pressure against piston 32 in the cylinder 34, the arms 24, 26 are cammed apart, overcoming the inward bias, causing the gripping elements to disengage, and allowing the fabric piece to be deposited.

Figure 3:
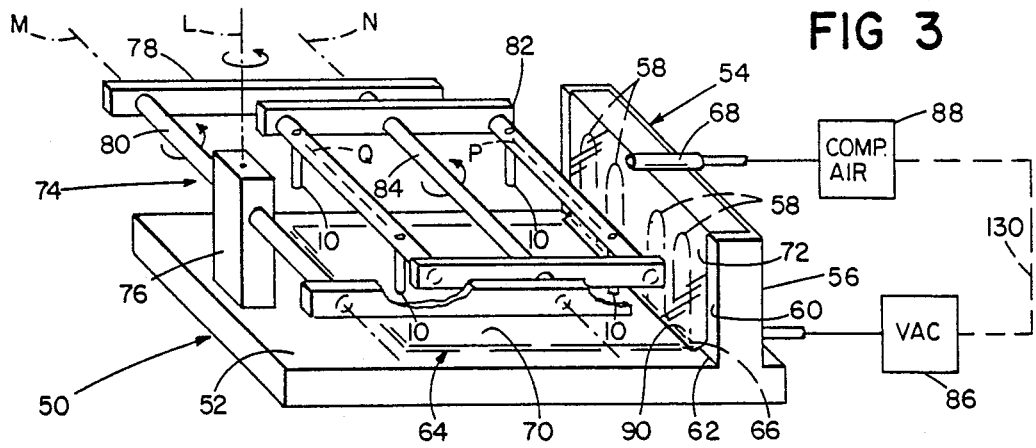
FIG. 3 is a perspective view of a pickup apparatus employing a number, of the pickup devices of FIG. 1.
Figure 4:
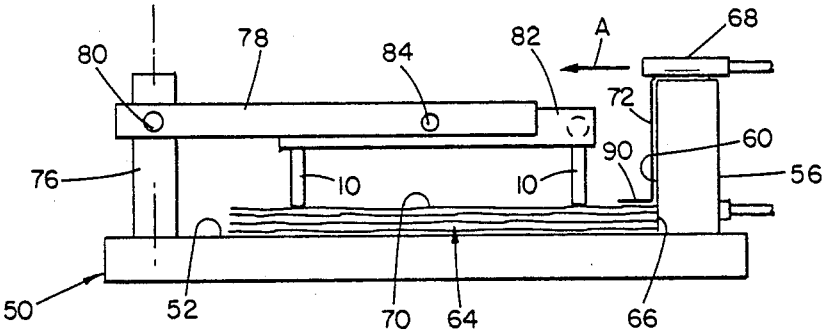
Figure 5:
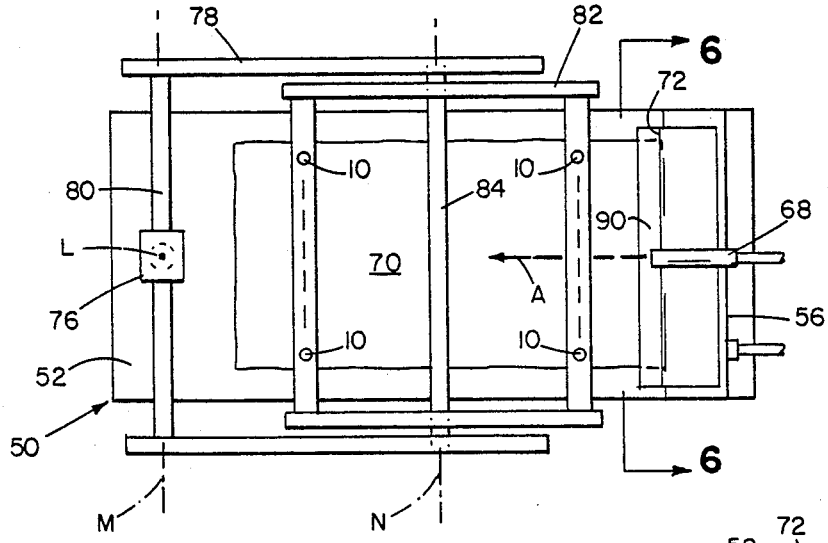
Figure 6:
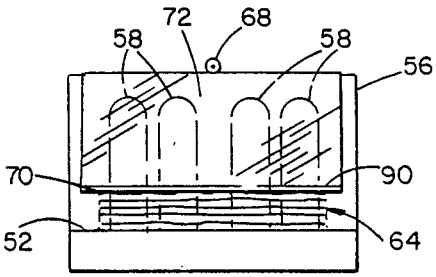
FIG. 6 is a face view of the stack-engaging surface of a stack stabilizing device taken on line 6—6 of FIG. 5.

The pickup devices of the invention are typically employed in a system of a multiplicity of pickup devices mounted on a support frame. Due to the relative inexpensive nature of the pickup devices described, it is economically feasible to employ a greater number than has been typical in the past, thus precise spatial control of the fabric piece engaged is possible. One such system, shown in FIG. 3, is particularly adapted for removing a single face piece of fabric or the like from a stack of pieces, even in situations where separation is made more difficult, e.g., by thread entanglement, edge welds, due to saw or laser action, holes in the fabric, or laps.

The apparatus 50 of the invention consists of a support surface 52 and a stack-stabilizing or holdback device 54 consisting of a vacuum box 56 having vacuum inlets 58 defined in the stabilizing surface 60, parallel to edge 62 of the support surface. Disposed upon the support surface is a stack 64 of pieces of flaccid fabric, or the like, having at least one aligned edge 66, which is positioned in face-to-face contact with surface 60 of the vacuum box 56. Air nozzle 68 is disposed between vacuum inlets in a position to direct, upon demand, a jet of air along axis A beyond the surface 60 of the vacuum box, generally parallel to and above the face surface 70 of the top piece of fabric in the stack. A flexible sheet 72 of imperforate plastic material, e.g. Mylar ®, s attached along one edge to the top of the vacuum box, above the vacuum inlets, and is of length to cover the vacuum inlet surface 60 of the vacuum box exposed above the stack and extend onto the face surface 70 of the stack when the vacuum is activated, as described below A support frame 74, which carries a multiplicity of the pickup devices 10 (FIGS. 1 and 2) of the invention, consists of a post member 76, extending vertically from the support surface 2 and rotatable about axis, L, a first frame portion 78 supported by horizontal arm 80 and rotatable about axis, M, and a second frame portion 82 supported by horizontal arm 84 and rotatable about axis, N.

The second frame portion supports an array of pickup devices 10 of the invention (four are shown by way of example) which are biased in the closed, fabric-gripping position. The pickup devices are typically arranged in two lines adjacent the periphery of the face piece of fabric, a first line, P, adjacent the aligned edge 66 of the fabric piece stack against the vacuum inlet surface 60, and a second line, Q, adjacent the opposite edge, spaced from the holdback device 54.

The vacuum box 56 is connected to a source of vacuum 6, and the air nozzle 68 is connected to a source of compressed air 88. During at least the operation of engaging the gripping elements of the pick-up devices 10 upon the face sheet of fabric on the stack, the pickup devices are also connected to a source of compressed air, as described below.

Figure 7:
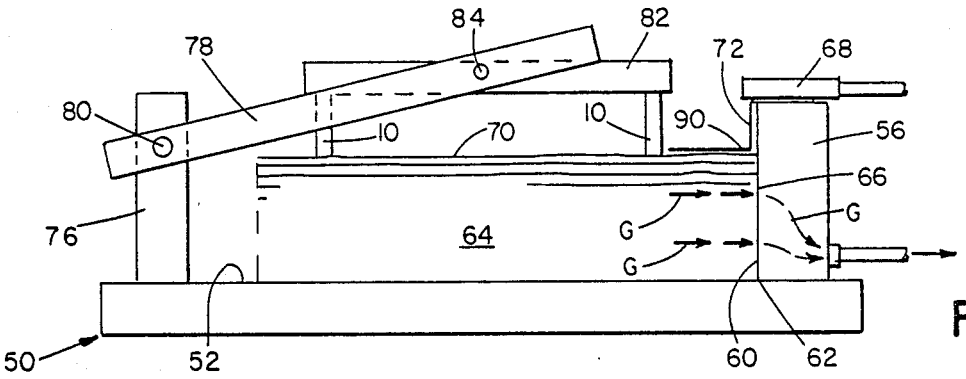
FIGS. 7 through 9 are side views of the apparatus of FIG. 3 during a sequence of separating and removing a face piece of fabric from a stack of pieces.

Referring to FIG. 7, with the stack 64 of fabric pieces disposed upon the support surface 52, and their aligned edges 66 in contact with vacuum inlet surface 60, the source of vacuum 86 is activated to draw vacuum, indicated by arrows, G, through the inlets 58 to exert a holdback force upon the pieces of fabric in the stack. The pressure differential draws the imperforate sheet of plastic 72 into covering engagement with the vacuum inlet surface 60, essentially stemming loss of vacuum through the exposed openings to increase the holdback effect. The free end segment 90 of the plastic also bears against the surface of the stack to act as a holddown sheet, further improving performance in separation and removal of a single face sheet.

The pickup devices 10 of FIGS. 1 and 2 are connected to a source of compressed air (88), which causes the gripping elements 24, 26 to be separated from the normally closed, fabric gripping position (FIG. 1), to the open position (FIG. 2). The second frame portion 82, bearing the pickup devices 10, is maneuvered over the face surface 70 of the stack 64, and the gripping elements 24, 26 of the pickup devices engaged upon the surface of the face sheet (FIG. 7). Flow of compressed air to the pickup devices is stopped, and the gripping elements return automatically to the closed, fabric gripping condition of FIG. 1, gripping the face sheet only of the fabric, as has been earlier described.

Flow of compressed air from source 88 to the nozzle 68 mounted between the vacuum inlets is actuated to create an air jet, indicated by arrows, F, extending beyond the vacuum inlet surface 60, above the plane 70 of the face sheet of the fabric.

Figure 8:
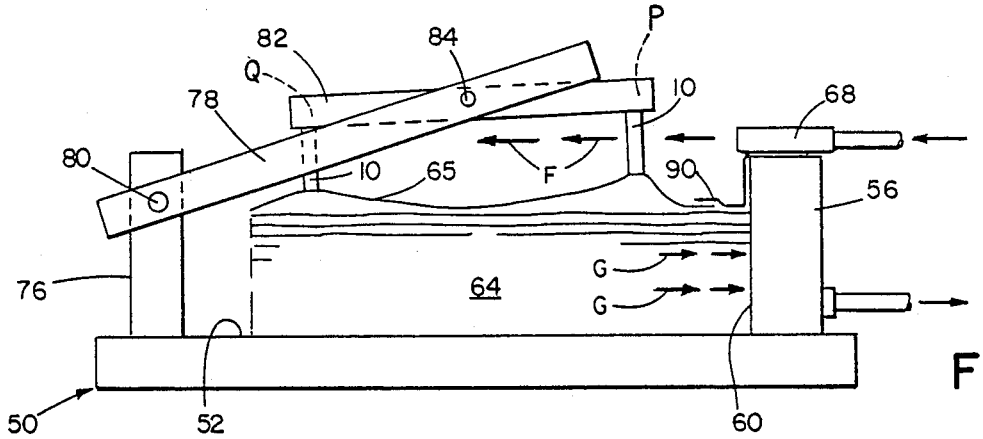
Figure 9:
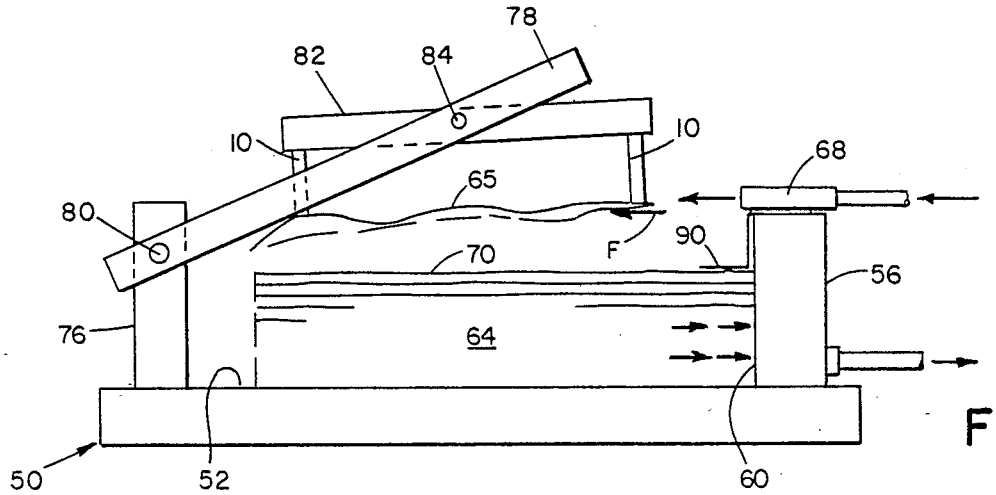

Referring now to FIG. 8, the pickup devices 10, gripping the face sheet only from the stack, are raised from the stack, with the front line, P, of pickup devices adjacent the holdback device 54 being raised first. As shown in the figure, separation of the face sheet from the underlying sheets in the stack is occurring in the vicinity of the first line, P, of pickup devices. The lifting of the pickup devices closest to the holdback device first (accomplished, e.g., by rotation of frame portions 78, 82 about axes M, N, at 80 and 84, respectively or by providing each pickup device or line of device with individual lifters having a programmed sequence of actuation) causes the face sheet to be "peeled back". This motion, in combination with the fluttering caused by the air jet, serves to disengage the edges of the face sheet from the underlying stack. Referring still to FIG. 8, the flow of air from the nozzle 68 above the face sheet upper surface 70 causes some slight rippling of the sheet, which aids separation. As the line, P, of pickup devices adjacent the holdback device is raised above the level of the nozzle, peeling the face sheet from the stack, the jet of air first rapidly disengages the front edge of the fabric 65 from beneath the holddown sheet 90, then the flow of air from the nozzle 68, now directed beneath and against the undersurface of the raised fabric sheet 65 causes the fabric to flutter, thereby, in combination with the peeling motion, freeing the edges of the face sheet of fabric held by the pickup devices from the underlying pieces of fabric still held in the stack. By movement of the several frame portions about their axes of rotation, the single separated piece of fabric, held generally about its periphery by a multiplicity of pickup devices, is transported to, and then deposited at, a desired location remote from the stack by reactivating the flow of compressed air to the pickup devices 10 to separate the gripping elements 24, 26 and release the piece of fabric.

Due to the low cost of the pickup devices of the invention, a greater number of devices can be employed at each pickup station, with a resulting increase in control of the fabric piece pickup, and negligible effect when individual devices in the system fail to engage the fabric.

As the pickup devices 10 maintain the fabric gripping condition in the absence of air flow, the devices can be disconnected from a first source of compressed air and the separated piece of fabric gripped by the set of devices transported to a remote location, where the fabric is released by connecting the pickup devices to a second source of compressed air. Furthermore, the positive gripping action of the large multiplicity of pickup devices employed allows the gripped fabric to be transported in any orientation and through any change in orientation, retaining at all times positive control over the fabric piece and its spatial disposition.

Figure 10:
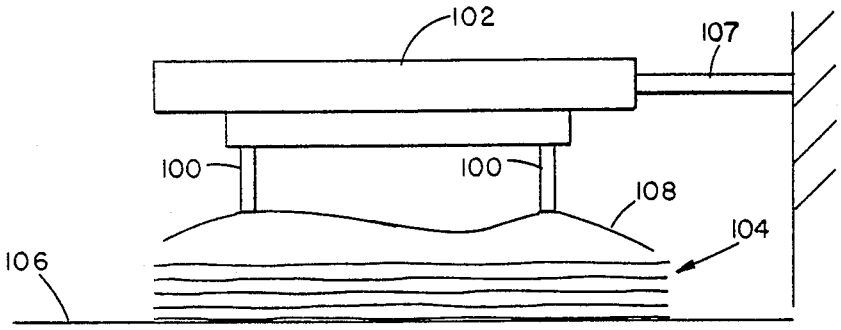
FIGS. 10 through 12 are diagrammatic views of another embodiment of a pickup apparatus of the invention.
Figure 11:
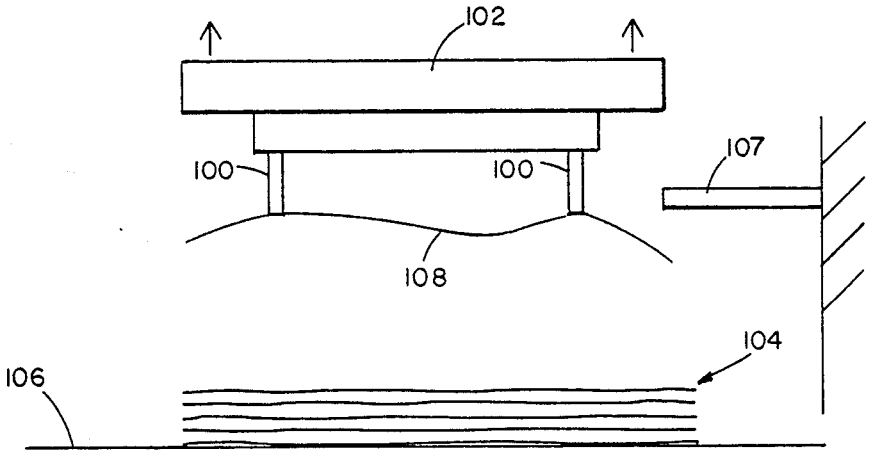
Figure 12:
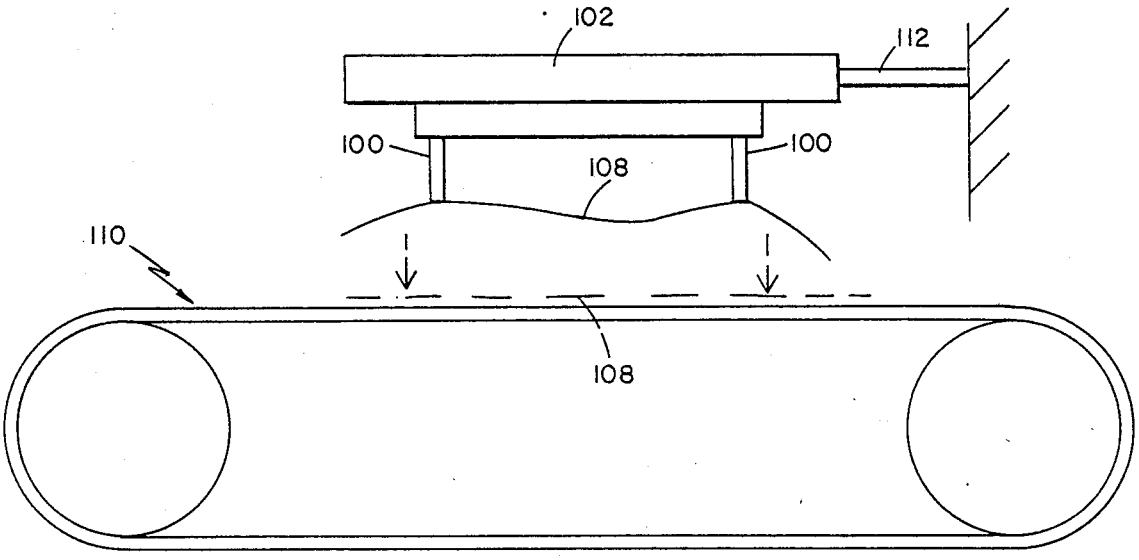

The pickup devices of the invention can also be employed with other pickup apparatus for picking up a single face piece of fabric, e.g., from a stack of pieces, and transporting and depositing the piece of fabric at a location remote from the stack. Referring to FIGS. 10–12, pickup devices 100, as described above, are mounted on a traveling frame 102. The frame is lowered over a stack 104 of fabric pieces on surface 106. As the frame is lowered over the stack, connection is made, e.g., automatically, with a compressed air source via conduit 107 to actuate the pickup devices and separate the normally closed (FIG. 1) gripping elements to the open, fabric gripping condition (FIG. 2). After the face sheet 108 of fabric is engaged, the source of compressed air is deactuated, causing the pickup devices to return to the normally closed position (FIG. 1), gripping the face piece of fabric. Referring to FIG. 11, the frame 102, with pickup devices gripping the fabric piece adjacent its edges, is separated from conduit 107 and moved to another remote location, transporting the fabric piece 108 without connection to an air supply. At the desired location,

110 or vacuum platen supplying a further process step, the pickup devices on the frame are reconnected via conduit 112 to a source of compressed air and reactuated for separation of the gripping elements to deposit the fabric piece onto the conveyor 110.

Other embodiments are within the following claims. For example, other means for separating the gripping elements may be employed in place of the camming action of the axially-movable piston, e.g., a rotary cam, a solenoid, or an inflatable bladder. Also, the gripping elements may move directly together to grip the fabric, without lateral motion to simultaneously tension the fabric. Also, at least a portion of the compressed air supplied to the air nozzle may be provided by operation of the vacuum source associated with the holdback device, e.g., as indicated by dashed line 130 in FIG. 3.

What is claimed is:

1. A pickup device for a piece of sheet-form flexible fabric or the like comprising:

first and second fabric gripping elements adapted to come together in a gripping position at the face of said fabric piece to grip a localized portion of the fabric, said gripping elements defining gripping lines that come together in said gripping position, support means for resiliently biasing said fabric gripping elements together in said gripping position, support means for resiliently biasing said fabric gripping elements together in said gripping position, said support means comprises a pair of elongated spring arms that are biased together, actuatable separating means for applying force to said support means for overcoming said biasing, said separating means comprises a carrying means slidable between opposed inner surfaces of said spring arms to progressively move said gripping elements and thus said gripping lines apart, said gripping lines lying at an angle to a direction of movement of said spring arms, upon deactuation of said separating means, said support means resiliently carries said gripping elements generally toward each other and laterally thereto in order to grip the fabric while applying tension to the fabric, whereby, when the gripping elements reach a final gripping position, the fabric has previously been tensioned by motion of said gripping elements.

2. The pickup device of claim 1 wherein said separating means are air actuated.

3. The pickup device of claim 2 wherein said air actuated separating means is a camming means.

4. The pickup device of claim 1 wherein said gripping elements are constructed and arranged to accommodate and clamp a tension-produced gather in the face of the fabric.

5. The pickup device of claim 1 wherein said first and second gripping elements have teeth, and teeth on the first gripping element are matched in opposition to respective teeth on the second gripping element, against which they clamp the fabric.

6. The pickup device of claim 5 wherein teeth of said first and second gripping elements are adapted to enter into spaces between teeth respectively of the second and first gripping elements as they clamp the fabric.

7. The pickup device of claim 1 wherein said gripping elements are mounted on support means that resiliently close together to produce the motion of said gripping elements upon deactuation of said separating means, and said separating means comprises a camming means arranged to force said support means apart.

8. The pickup device of claim 1 in combination with means for moving said device in a conveying motion away from a position at which said fabric piece is gripped.

9. The pickup device of claim 1 arranged above a stack of pieces and including means for removing a face piece only from said stack.

10. A pickup device for a piece of sheet-form flexible fabric or the like comprising:

first and second fabric gripping elements adapted to come together at the face of said fabric piece to grip a localized portion of the fabric, support means for resiliently biasing said fabric gripping elements together in a gripping position, actuatable separating means for applying force to said support means for overcoming said biasing to move said fabric gripping elements apart, upon deactuation of said separating means, said support means resiliently returns said gripping elements to said gripping position, said gripping elements being mounted on said support means that resiliently close together to produce the motion of said gripping elements upon deactuation of said separating means, said separating means comprising a camming means arranged to force said support means apart, said support means comprising a pair of elongated spring arms that are biased together, and said camming means comprising means slidable between opposed inner surfaces of said spring arms to progressively force them apart.

11. The pickup device of claim 10 wherein said elongated spring arm are arranged to move relatively in a predetermined lateral direction between open and closed positions and each of said gripping elements comprises a set of points conforming to the plane of said face and set at an angle to said predetermined lateral direction.

* * * * *